US007291050B2

(12) United States Patent
Kim et al.

(10) Patent No.: US 7,291,050 B2
(45) Date of Patent: Nov. 6, 2007

(54) METHOD OF FORMING DIELECTRIC ON AN UPPER SUBSTRATE OF A PLASMA DISPLAY PANEL

(75) Inventors: Je Seok Kim, Anyang-si (KR); Woo Sung Jang, Seoul (KR); Ju Min Kim, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 45 days.

(21) Appl. No.: 10/879,526

(22) Filed: Jun. 30, 2004

(65) Prior Publication Data

US 2006/0003661 A1 Jan. 5, 2006

(51) Int. Cl.
*H01J 9/00* (2006.01)
*H01J 17/49* (2006.01)

(52) U.S. Cl. ..... 445/24; 445/25; 501/11; 501/17; 501/20

(58) Field of Classification Search ..... 445/24, 445/25

See application file for complete search history.

(56) References Cited

U.S. PATENT DOCUMENTS 5,548,186 A * 8/1996 Ota ..... 313/583
2005/0062421 A1* 3/2005 Oshio et al. ..... 313/587

FOREIGN PATENT DOCUMENTS

JP 11065481 A * 3/1999
JP 2002289092 A * 10/2002
JP 2002289093 A * 10/2002

* cited by examiner

*Primary Examiner*—Mariceli Santiago
(74) *Attorney, Agent, or Firm*—Ked & Associates, LLP

(57) ABSTRACT

The present invention relates to a method of making a plasma display panel, and more specifically, a method of forming a dielectric layer on an upper substrate of a plasma display panel. According to first embodiment of the present invention, a method of forming a dielectric layer on an upper substrate of a plasma display panel, comprises steps of: forming a plurality of sustain electrodes on the upper substrate, and bus electrodes on the sustain electrodes; forming an electrode discoloration prevention layer which envelops said sustain electrodes and said bus electrodes, said electrode discoloration prevention layer including a green sheet by first casting; forming a penetration rate enhancement layer on the electrode discoloration prevention layer, said penetration rate enhancement layer including a green sheet by second casting.

18 Claims, 4 Drawing Sheets

METHOD OF FORMING DIELECTRIC ON AN UPPER SUBSTRATE OF A PLASMA DISPLAY PANEL

BACKGROUND OF THE INVENTION

1. Field of the Invention

The present invention relates to a method of making a plasma display panel, and more specifically, a method of forming a dielectric layer on an upper substrate of a plasma display panel.

2. Description of the Background Art

A plasma display panel (hereafter, PDP) has a matrix structure which can express full color display by using a fluorescent material. Typically, a surface discharge type PDP has upper and lower substrates between which sustain and address electrodes are arranged in a matrix form. Discharge cells are divided by barrier ribs. In the discharge cells, ultraviolet rays are generated from plasma radiation of He—Ne and Ne—Xe gases. The ultraviolet rays stipulate the fluorescent material. When the fluorescent material transit from excited state to ground state, radiation occurs by energy difference between the excited and the ground states. In this way, display is achieved.

The manufacturing method of PDP comprises processes of making the upper and lower substrates and packaging them. The manufacturing method further comprises a process of forming the dielectric layer on the upper substrate.

According to the conventional process of forming the dielectric layer, the method of forming the dielectric layer comprises steps of: printing by screen printing technique which is repeated at least 5 times; drying; and firing which is repeated at least 2 times. Since the conventional method includes many steps, cycle time of the overall process became very long.

Further, according to the conventional process, mesh mark of screen mask which is generated during screen printing step remains even after firing. Therefore, the surface roughness of the final product decreases.

And, because the PDP passes through a plurality of printing and drying steps, the thickness of the dielectric layer is not uniform.

In order to solve these problems, the dielectric layer is made of green sheet, which is also called green tape, by using the tape casting device.

FIG. 1 shows a section view of an upper substrate of a PDP according to the background art. As shown in FIG. 1, the upper substrate of the PDP comprises glass substrate 10; a plurality of sustain electrodes 11, 12, 13, 14, which comprises ITO (indium oxide In.sub.2 O.sub.3 and tin oxide SnO.sub.2 semiconductor) film formed on the upper substrate; a plurality of bus electrodes 21, 22, 23, 24, 25, 26, 27, 28 which is formed on the sustain electrodes; and a dielectric green sheet 30 which envelops the sustain electrodes and bus electrodes and is formed on the glass substrate.

As this dielectric green sheet 30 is laminated on the sustain electrode and bus electrode of the glass substrate 10 and fired, the characteristics of the dielectric of the upper substrate are very good such that the surface roughness is less than or equal to 500 Å, the tolerance voltage is more than or equal to 5 KV, and the thickness uniformity is in ±1 μm.

As, by using this green sheet, the working process becomes very simple and the cycle time becomes short, the manufacturing cost decreases.

However, in this method of forming dielectric layer by using green sheet, the strength of the green sheet must remain over than some value in order to treat the green sheet easily in the process which the green sheet is laminated on the upper substrate. The reason is because it is possible to prevent the laminating badness by extending of the green sheet and the badness of the dielectric layer thickness after firing only if the strength of the green sheet must remains.

However, these green sheet of unique layer discolors the sustain and bus electrodes, decreases the penetration ratio, and generates some cracks on the MgO layer which is formed on the green sheet.

Recently, in the forming of the bus electrode, the printing method of Ag-paste is used rather than the conventional vacuum plating of Cr—Cu—Cr. However, in the printing method of Ag-paste, there is edge curl on the bus electrode which is the phenomenon that the side of the bus electrode is rolled during the processes of exposuring to light, etching, and firing.

FIG. 2 shows a picture of section of upper substrate of PDP according to the background art which is photographed by 20 magnification. As shown in FIG. 2, the bubbles are generated on the region where the dielectric contacts to the glass substrate and the electrodes.

SUMMARY OF THE INVENTION

Accordingly, an object of the present invention is to solve at least the problems and disadvantages of the background art.

An object of the present invention is to provide a method of forming a dielectric layer on an upper substrate of a plasma display panel, which can improve a penetration ratio characteristic and prevent an electrode from discoloring and MgO from cracking by forming a dielectric green sheet of multi-layer by laminating by multi-casting device and firing.

Another object of the present invention is to provide a method of forming a dielectric layer on an upper substrate of a plasma display panel, which can prevent bubbles from being generated in the region where a dielectric contacts to an electrode by forming a dielectric green sheet of multi-layer by laminating by multi-casting device and firing.

According to first embodiment of the present invention, a method of forming a dielectric layer on an upper substrate of a plasma display panel, comprises steps of: forming a plurality of sustain electrodes on the upper substrate, and bus electrodes on the sustain electrodes; forming an electrode discoloration prevention layer which envelops said sustain electrodes and said bus electrodes, said electrode discoloration prevention layer including a green sheet by first casting; forming a penetration rate enhancement layer on the electrode discoloration prevention layer, said penetration rate enhancement layer including a green sheet by second casting.

According to second embodiment of the present invention, a method of forming a dielectric layer on an upper substrate of a plasma display panel, comprises steps of: forming a plurality of sustain electrodes on the upper substrate, and bus electrodes on the sustain electrodes; forming a bubble prevention layer which envelops said sustain electrodes and said bus electrodes, said bubble prevention layer including a green sheet by first casting; and forming a sheet strength supporting layer on said bubble prevention layer, said sheet strength supporting layer including a green sheet by second casting.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

First Embodiment

According to first embodiment of the present invention, a method of forming a dielectric layer on an upper substrate of a plasma display panel, comprises steps of: forming a plurality of sustain electrodes on the upper substrate, and bus electrodes on the sustain electrodes; forming an electrode discoloration prevention layer which envelops said sustain electrodes and said bus electrodes, said electrode discoloration prevention layer including a green sheet by first casting; forming a penetration rate enhancement layer on the electrode discoloration prevention layer, said penetration rate enhancement layer including a green sheet by second casting.

Figure 1:
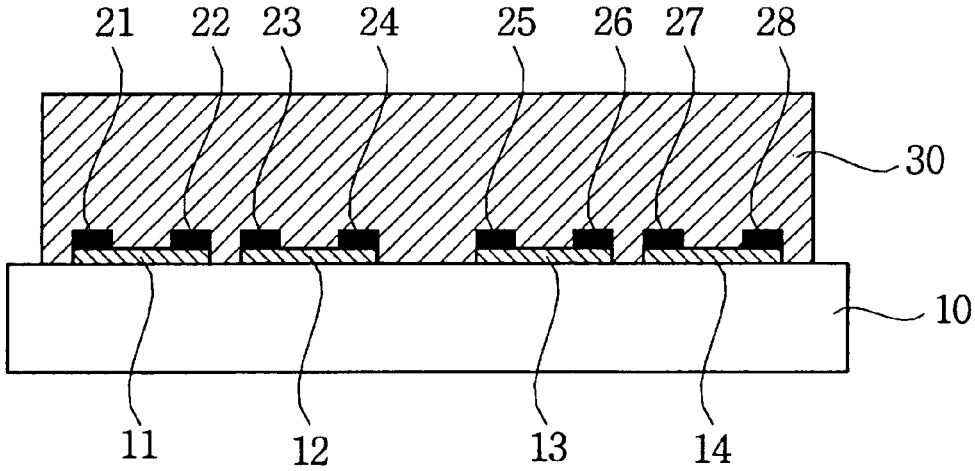
FIG. 1 shows a section view of an upper substrate of a PDP according to the background art.
Figure 2:
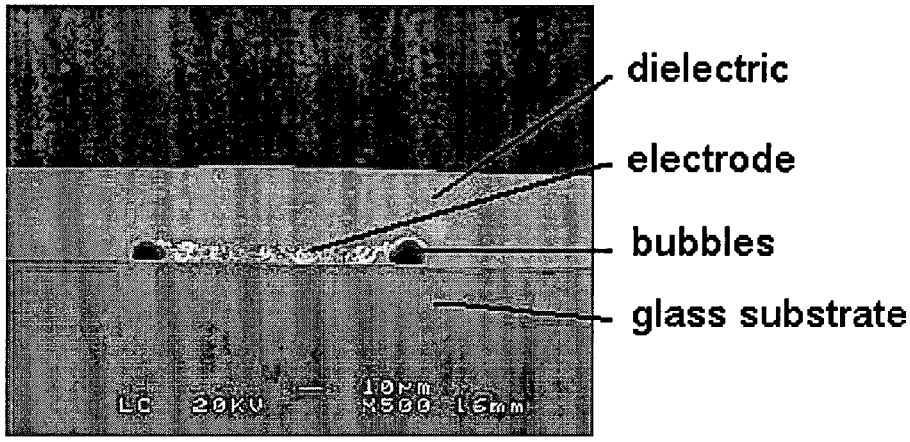
FIG. 2 shows a picture of section of upper substrate of PDP according to the background art which is photographed by 20 magnification.
Figure 3:
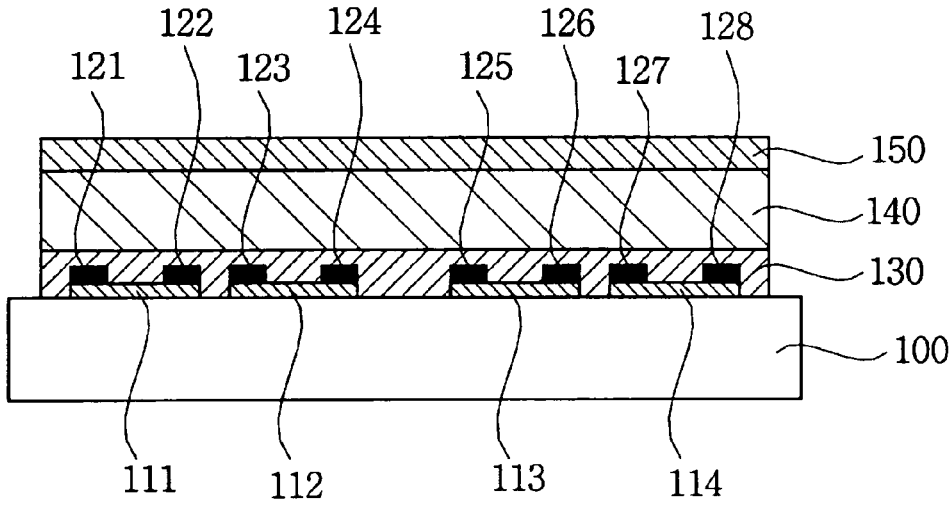
FIG. 3 shows a section view of an upper substrate of a PDP in accordance with first embodiment of the present invention.

FIG. 3 shows a section view of an upper substrate of a PDP in accordance with first embodiment of the present invention.

As shown in FIG. 3, the upper substrate of a PDP in accordance with first embodiment of the present invention comprises a glass substrate 100; a plurality of sustain electrodes 111, 112, 113, 114, which comprises ITO film formed on the upper substrate; a plurality of bus electrodes 121, 122, 123, 124, 125, 126, 127, 128 which are formed on the sustain electrodes; an electrode discoloration prevention layer 130 which envelops the sustain electrodes and bus electrodes and is formed on the glass substrate; a penetration rate enhancement layer 140 which is formed on the electrode discoloration prevention layer; and a MgO cracking prevention layer 150 which is formed on the penetration rate enhancement layer.

The basic characteristic of first embodiment of the present invention is that the electrode discoloration prevention layer 130 is formed by the first casting and the penetration rate enhancement layer 140 is formed on the electrode discoloration prevention layer 130 by the second casting.

Further, the MgO cracking prevention layer 150 can be formed on the penetration rate enhancement layer 140.

The electrode discoloration prevention layer 130 is made of slurry which mixes electrode discoloration prevention powder with organic compounds binder, which is ASAI's YFT-065F. The penetration rate enhancement layer 140 is made of slurry which mixes powder for rising penetration ratio with organic compounds binder, that is ASAI's YFT-340.

If the MgO layer is formed on the penetration rate enhancement layer 140, in order to prevent the MgO layer from cracking, the MgO cracking prevention layer 150, which is same green sheet to the electrode discoloration prevention layer 130, is formed on the penetration rate enhancement layer 140.

Figure 4:
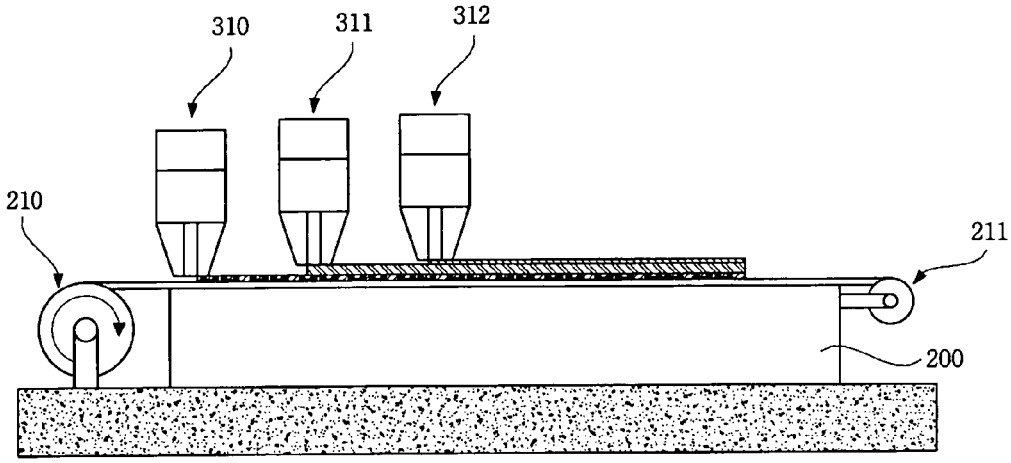
FIG. 4 shows a schematic diagram which illustrates a process forming a dielectric layer on the upper substrate of PDP by using multi-tape casting device according to first embodiment of the present invention.

FIG. 4 shows a schematic diagram which illustrates a process forming a dielectric layer on the upper substrate of PDP by using multi-tape casting device according to first embodiment of the present invention.

As shown in FIG. 4, the multi-tape casting device comprises a supporting part 200; a first roller 210 and a second roller 211 which is installed at one side and other side of the supporting part 200; and a first, second, and third dies 310, 311, 312 which include slurry and cast green sheet.

The glass substrate 100 which includes a plurality of sustain and bus electrodes, is set on the supporting part 200, and the first through the third casting dies 310, 311, 312 in sequence cast green sheet on the glass substrate 100.

The first casting die 310 forms the electrode discoloration prevention layer 130 by casting the slurry on the glass substrate 100. The second casting die 311 forms the penetration rate enhancement layer 140 by casting the slurry on the electrode discoloration prevention layer 130.

The third casting die 312 forms the MgO cracking prevention layer 150 by casting the slurry on the penetration rate enhancement layer 140.

And then, as the green sheets, laminated by multi-layer, are fired, the forming of the dielectric layer on the upper substrate of FDP becomes completed.

Table 1 is the test result of the dielectric which is formed on the upper substrate of a PDP according to first embodiment of the present invention. In the case of unique layer green sheet, the penetration ratio is low, discoloration occurs, and the crack of the MgO layer is generated. However, in the case of multi-layer, which is composed of the electrode discoloration prevention layer and the penetration rate enhancement layer, according to first embodiment of the present invention, the penetration ratio rises, discoloration does not occur, and the crack of the MgO layer is not generated.

TABLE 1

| No. | dielectric layer | Penetration rate | discoloring | MgO crack |
|---|---|---|---|---|
| 1 | 1-layer (ASAI's YFT-065F) | 74% | no | no |
| 2 | 1-layer (ASAI's YFT-094) | — | many | yes |
| 3 | 1-layer (ASAI's YFT-340) | — | some | no |
| 4 | 2-layer (ASAI's YFT-065F/ YFT-340) | 78% | no | no |
| 5 | 3-layer (ASAI's YFT-065F/ YFT-094/YFT-065F) | 79% | no | no |

Further, as the working process of the present invention becomes very simple and the cycle time becomes short, the manufacturing cost decreases.

Further, the bus electrodes can be made of Ag-paste. In this case, the characteristics of the first embodiment of the present invention also can be applied, and the effects, which are said above, can be achieved.

Second Embodiment

According to second embodiment of the present invention, a method of forming a dielectric layer on an upper substrate of a plasma display panel, comprises steps of: forming a plurality of sustain electrodes on the upper substrate, and bus electrodes on the sustain electrodes; forming a bubble prevention layer which envelops said sustain electrodes and said bus electrodes, said bubble prevention layer including a green sheet by first casting; and forming a sheet strength supporting layer on said bubble prevention layer, said sheet strength supporting layer including a green sheet by second casting.

Figure 5:
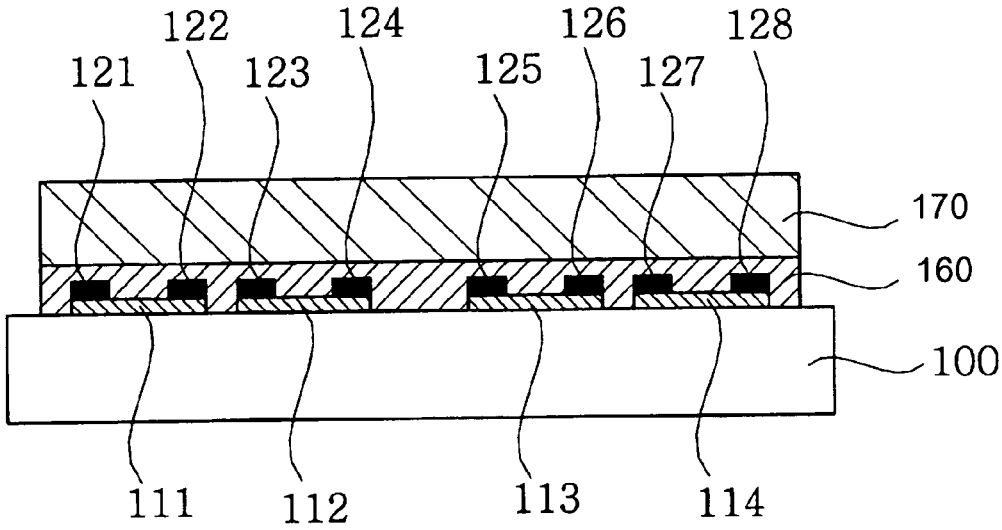
FIG. 5 shows a section view of an upper substrate of a PDP in accordance with second embodiment of the present invention.

FIG. 5 shows a section view of an upper substrate of a PDP in accordance with second embodiment of the present invention.

As shown in FIG. 5, The upper substrate of a PDP in accordance with second embodiment of the present invention comprises a glass substrate 100; a plurality of sustain electrodes 111, 112, 113, 114, which comprises ITO film formed on the upper substrate; a plurality of bus electrodes 121, 122, 123, 124, 125, 126, 127, 128 which are formed on the sustain electrodes; a bubble prevention layer 160 which envelops the sustain electrodes and bus electrodes and is formed on the glass substrate; and a sheet strength supporting layer 170 which is formed on the bubble prevention layer 160.

The basic characteristic of second embodiment of the present invention is that the bubble prevention layer 160 is formed by the first casting and the sheet strength supporting layer 170 is formed on the bubble prevention layer 160 by the second casting.

Here, the bubble prevention layer 160 includes green sheet which contains binder and plasticizer with composition ratio of 1 and 1~0.5 for the binder and the plasticizer, respectively.

The sheet strength supporting layer 170 includes green sheet which contains binder and plasticizer with composition ratio of 1 and 0.5~0.1 for the binder and the plasticizer, respectively.

The sheet strength supporting layer 170 can include Tackifier.

Figure 6:
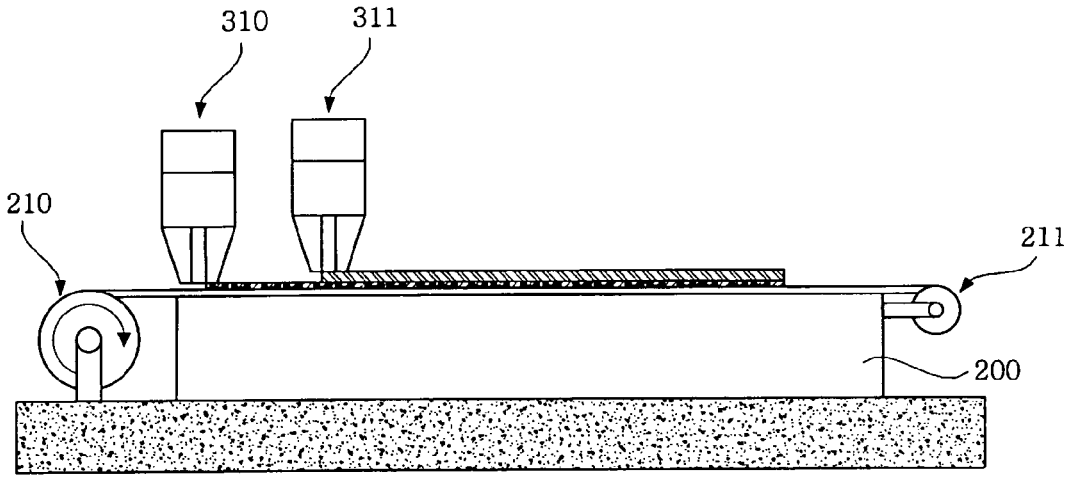
FIG. 6 shows a schematic diagram which illustrates a process forming a dielectric layer on the upper substrate of PDP by using multi-tape casting device according to second embodiment of the present invention.

FIG. 6 shows a schematic diagram which illustrates a process forming a dielectric layer on the upper substrate of PDP by using multi-tape casting device according to second embodiment of the present invention.

As shown in FIG. 6, the multi-tape casting devices comprises a supporting part 200; a first roller 210 and a second roller 211 which is installed at one side and other side of the supporting part 200; and a first and second dies 310, 311 which include slurry and cast green sheet.

The glass substrate 100, which includes a plurality of sustain and bus electrodes, is set on the supporting part 200, and the first and the second casting dies 310, 311 in sequence cast green sheet on the glass substrate 100.

The first casting die 310 forms the bubble prevention layer 160 by casting the slurry on the glass substrate 100.

The second casting die 311 forms the sheet strength supporting layer 170 by casting the slurry on the bubble prevention layer 160.

As the green sheets, laminated by multi-layer, are fired, the forming of the dielectric layer on the upper substrate of PDP becomes completed.

Figure 7:
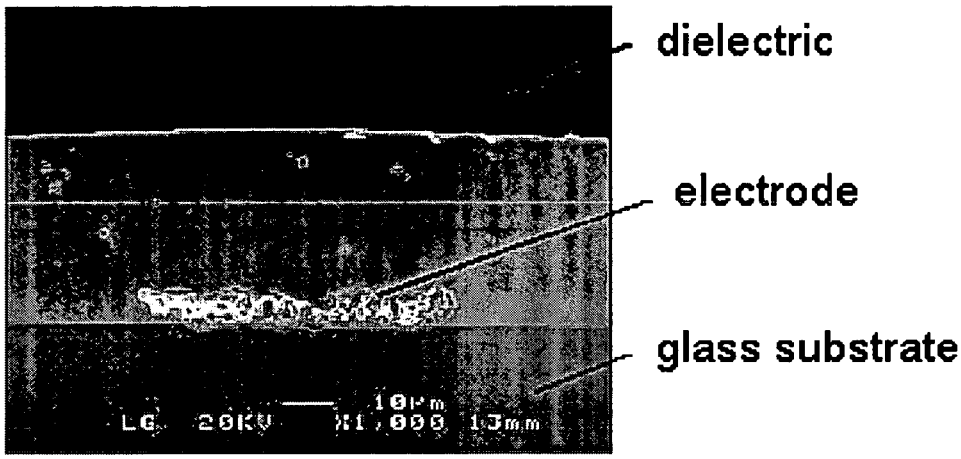
FIG. 7 shows a picture of section of upper substrate of a PDP according to second embodiment of the present invention which is photographed by 20 magnification.

FIG. 7 shows a picture of section of upper substrate of a PDP according to second embodiment of the present invention which is photographed by 20 magnification. As shown in FIG. 7, bubbles are not generated between the dielectric, electrodes and the glass substrate.

Further, the bus electrodes can be made of Ag-paste. In this case, the characteristics of the second embodiment of the present invention also can be applied, and the effects, which are said above, can be achieved.

Therefore, as the screen printing method is not used for forming the dielectric on the upper substrate of a PDP of the present invention, the manufacturing process becomes simple, and the bubbles are not generated in the region where the green sheet contacts to the electrodes.

The present invention can improve a penetration ratio characteristic and prevent an electrode from discoloring and MgO from cracking by forming a dielectric green sheet of multi-layer by laminating by multi-casting device and firing.

Further, the present can prevent bubbles from being generated in the region where a dielectric contacts to an electrode, and can make the manufacturing process simple by forming a dielectric green sheet of multi-layer by laminating by multi-casting device and firing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of forming a dielectric layer on an upper substrate of a plasma display panel, comprising steps of:

forming a first dielectric layer including a green sheet comprising plasticizer; and forming a second dielectric layer on the first dielectric layer, the second dielectric layer including a green sheet comprising plasticizer that is more than 10 wt % and less than 50 wt % of the plasticizer of the first dielectric layer, wherein the second dielectric layer comprises additives to increase adhesiveness to the upper substrate.

2. The method of forming a dielectric layer on an upper substrate of a plasma display panel according to claim 1, wherein the first dielectric layer includes the green sheet that contains binder and the plasticizer having a composition ratio of 1 and 1~0.5 for the binder and the plasticizer, respectively.

3. The method of forming a dielectric layer on an upper substrate of a plasma display panel according to claim 1, wherein the second dielectric layer includes the green sheet that contains binder and the plasticizer having a composition ratio of 1 and 0.5~0.1 for the binder and the plasticizer, respectively.

4. The method of forming a dielectric layer on an upper substrate of a plasma display panel according to claim 3, wherein the second dielectric layer includes tackifiers.

5. The method of forming a dielectric layer on an upper substrate of a plasma display panel according to claim 1, wherein the first dielectric layer is formed on the upper substrate comprising a plurality of sustain electrodes and bus electrodes.

6. The method of forming a dielectric layer on an upper substrate of a plasma display panel according to claim 5, wherein the bus electrodes are made of Ag-paste.

7. The method of forming a dielectric layer on an upper substrate of a plasma display panel according to claim 1, wherein the first dielectric layer and the second dielectric layer are simultaneously fired.

8. A method of forming a plasma display comprising providing a first dielectric layer on a substrate; and providing a second dielectric layer on the first dielectric layer, the second dielectric layer including a green sheet having plasticizer that is more than 10 wt % and less than 50 wt % of a green sheet of the first dielectric layer having plasticizer, wherein the second dielectric layer includes an additive to increase adhesiveness.

9. The method of claim 8, wherein the first dielectric layer includes the green sheet having the plasticizer and binder.

10. The method of claim 9, wherein the binder and the plasticizer of the first dielectric layer have a composition ratio of 1 and 1~0.5.

11. The method of claim 8, wherein the second dielectric layer includes the green sheet having binder and the plasticizer.

12. The method of claim 11, wherein the binder and the plasticizer of the first dielectric layer have a composition ratio of 1 and 1~0.5.

13. The method of claim 8, wherein the first dielectric layer is formed on the substrate, and a plurality of sustain electrodes and bus electrodes are formed on the substrate.

14. The method of claim 13, wherein the bus electrodes comprise Ag-paste.

15. The method of claim 8, wherein the first dielectric layer and the second dielectric layer are simultaneously fired.

16. The method of claim 8, wherein the first dielectric layer comprises a bubble prevention layer and the second dielectric layer comprises a sheet strength supporting layer.

17. The method of claim 8, further comprising:

forming a plurality of sustain electrodes on the substrate; and forming a plurality of bus electrodes on the plurality of sustain electrodes.

18. The method of claim 17, wherein providing the first dielectric layer includes providing the first dielectric layer to envelop the sustain electrodes and the bus electrodes.

* * * * *